US008057612B2

(12) United States Patent
Brisighella et al.

(10) Patent No.: US 8,057,612 B2
(45) Date of Patent: Nov. 15, 2011

(54) METHODS OF FORMING A MULTI-COMPOSITION PYROTECHNIC GRAIN

(75) Inventors: Dario Brisighella, North Logan, UT (US); Brett Hussey, Bountiful, UT (US)

(73) Assignee: Autoliv ASP, Inc., Ogden, UT (US)

( * ) Notice: Subject to any disclaimer, the term of this patent is extended or adjusted under 35 U.S.C. 154(b) by 897 days.

(21) Appl. No.: 11/837,842

(22) Filed: Aug. 13, 2007

(65) Prior Publication Data

US 2009/0044885 A1 Feb. 19, 2009

(51) Int. Cl.

| | |
|---|---|
| ***C06B 45/00*** | (2006.01) |
| ***C06B 45/12*** | (2006.01) |
| ***D03D 23/00*** | (2006.01) |
| ***D03D 43/00*** | (2006.01) |

(52) U.S. Cl. ..... 149/109.6; 149/2; 149/14; 149/108.6; 149/109.4

(58) Field of Classification Search ..... 149/109.6, 149/18, 2, 14, 108.6, 109.4
See application file for complete search history.

(56) References Cited

U.S. PATENT DOCUMENTS

| | | | | |
|---|---|---|---|---|
| 2,921,521 | A | 1/1960 | La Haye et al. | 102/39 |
| 3,255,281 | A | 6/1966 | Alexander | 264/3 |
| 3,722,354 | A | 3/1973 | Herty, III | 86/1 |
| 3,724,870 | A | 4/1973 | Kurokawa et al. | 280/150 |
| 3,986,908 | A | 10/1976 | Grebert et al. | 149/19.7 |
| 4,099,376 | A | 7/1978 | Japs | 60/253 |
| 4,131,051 | A | 12/1978 | Schaffling | 86/1 R |
| 4,246,051 | A | 1/1981 | Garner et al. | |
| 4,698,107 | A | 10/1987 | Goetz et al. | 149/7 |
| 4,806,180 | A | 2/1989 | Goetz et al. | 149/5 |
| 4,944,528 | A | 7/1990 | Nilsson et al. | 280/741 |
| 5,034,070 | A | 7/1991 | Goetz et al. | 149/3 |
| 5,051,143 | A | 9/1991 | Goetz | |
| 5,531,941 | A | 7/1996 | Poole | 264/3.4 |
| 5,562,303 | A | 10/1996 | Schleicher et al. | 280/736 |
| 5,623,115 | A | 4/1997 | Lauritzen et al. | 102/288 |
| 5,738,374 | A | 4/1998 | Marsaud et al. | 280/741 |
| 5,804,758 | A | 9/1998 | Marsaud et al. | 102/288 |
| 5,821,449 | A | 10/1998 | Langsjoen et al. | |
| 5,834,679 | A * | 11/1998 | Seeger | 102/288 |
| 6,029,994 | A | 2/2000 | Perotto et al. | 280/736 |
| 6,032,979 | A | 3/2000 | Mossi et al. | 280/741 |

(Continued)

FOREIGN PATENT DOCUMENTS

| | | |
|---|---|---|
| CN | 1303338 | 7/2001 |

(Continued)

OTHER PUBLICATIONS

Non-Final Office Action dated Mar. 23, 2011 issued in co-pending U.S. Appl. No. 12/789,057.

*Primary Examiner* — James McDonough
(74) *Attorney, Agent, or Firm* — Sally J. Brown; Harness Dickey & Pierce PLC

(57) ABSTRACT

A multi-composition pyrotechnic material is provided for an inflatable restraint device (for example, an airbag system or pretensioner for a vehicle). The multi-composition pyrotechnic material can be a gas generant, a micro gas generant, or an igniter, for example. The multi-composition pyrotechnic material comprises a first pyrotechnic material that defines one or more void regions. A second pyrotechnic material, compositionally distinct from the first pyrotechnic material, is introduced into at least one of the void regions and forms a second region of the pyrotechnic materials. The second composition can be introduced to the void regions in the form of a slurry. Methods of forming such multi-composition pyrotechnic materials are also provided.

23 Claims, 8 Drawing Sheets

U.S. PATENT DOCUMENTS

| | | | | |
|---|---|---|---|---|
| 6,322,649 | B1 | 11/2001 | Marsaud et al. | |
| 6,368,434 | B1 | 4/2002 | Espagnacq et al. | |
| 6,517,647 | B1 | 2/2003 | Yamato | 149/45 |
| 6,789,485 | B2 * | 9/2004 | Moquin et al. | 102/530 |
| 6,958,101 | B2 | 10/2005 | Mendenhall et al. | |
| 7,077,428 | B2 | 7/2006 | Barker et al. | |
| 7,470,337 | B2 * | 12/2008 | Mendenhall et al. | 149/45 |
| 7,758,709 | B2 * | 7/2010 | Hussey et al. | 149/23 |
| 2004/0112244 | A1 | 6/2004 | Barker et al. | |
| 2006/0102259 | A1 * | 5/2006 | Taylor et al. | 149/45 |
| 2009/0044886 | A1 | 2/2009 | Brisighella et al. | |
| 2010/0230945 | A1 | 9/2010 | Hussey et al. | |

FOREIGN PATENT DOCUMENTS

| | | |
|---|---|---|
| DE | 39 33 555 | 2/1991 |
| DE | 43 18 883 | 12/1993 |
| EP | 0 728 630 | 8/1996 |
| EP | 0 767 155 | 4/1997 |
| EP | 1118512 | 7/2001 |
| WO | WO 99/05079 | 2/1999 |
| WO | WO 01/08937 | 2/2001 |
| WO | WO 2007/149173 | 12/2007 |
| WO | WO 2008/051274 | 5/2008 |
| WO | WO 2009/023119 | 2/2009 |

* cited by examiner

METHODS OF FORMING A MULTI-COMPOSITION PYROTECHNIC GRAIN

FIELD

The present disclosure relates to passive restraint systems, and more particularly to gas generant pyrotechnic materials and methods of making such materials for use in passive restraint systems.

BACKGROUND

The statements in this section merely provide background information related to the present disclosure and may not constitute prior art.

Passive inflatable restraint systems are often used in a variety of applications, such as in motor vehicles. Certain types of passive inflatable restraint systems minimize occupant injuries by using a pyrotechnic gas generant to inflate an airbag cushion (gas initiators and/or inflators) or to actuate a seatbelt tensioner (micro gas generators), for example.

Improvements in gas generant performance remain desirable. Tailoring the performance of the gas generant in an inflatable device system, such as an airbag, can require a complex design of not only the gas generant, but also hardware systems that control gas flow.

Often current gas generants require dry mixing of two or three loose pyrotechnic materials or different shapes of pyrotechnics (discs or multiple-perforation grains and the like) to achieve unique output characteristics for state of the art automotive initiators and micro gas generators. Moreover, loose materials may classify or separate leading to variable burn characteristics.

It would be desirable to eliminate or reduce the need for dry mixing of multiple loose pyrotechnic materials and/or different shaped pyrotechnic materials to achieve unique and desirable output characteristics (tailored or tunable rates) for state of the art automotive initiators and micro gas generators. For example, it would be highly desirable to design an initiator or micro gas generator having a controlled onset or altered burn time, including tailoring the burn profile of the gas generant to have a sustained output with a slower or more progressive burn rate or characteristic as compared with conventional gas generant grains, thereby reducing variability, improving safety and handling, and increasing performance capabilities of pyrotechnic materials.

SUMMARY

According to various aspects, the present disclosure provides a method of forming a multi-composition pyrotechnic material comprises filling one or more void regions defined by a first solid region with a slurry. The first solid region comprises a first pyrotechnic composition and the slurry comprises a second pyrotechnic composition that is distinct from the first pyrotechnic composition. The slurry disposed within one or more void regions is dried to form a second solid region, thereby forming the multi-composition pyrotechnic material.

In another aspect, the present disclosure provides a method of forming a multi-composition pyrotechnic material comprises creating a solid body comprising a first pyrotechnic composition. The solid body defines one or more void regions. A second pyrotechnic composition is introduced into at least one of these void regions. Additionally, the first pyrotechnic composition is distinct from the second composition.

In yet another aspect, the disclosure provides a method of forming a multi-composition pyrotechnic material having a first region and a second region each comprising distinct pyrotechnic compositions. The method comprises making a first region of the pyrotechnic material comprising a first pyrotechnic composition and making a second region of the pyrotechnic material comprising a second pyrotechnic composition. The first pyrotechnic composition is distinct from the second pyrotechnic composition. Further, the second region occupies one or more void regions defined by the first region.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 9:
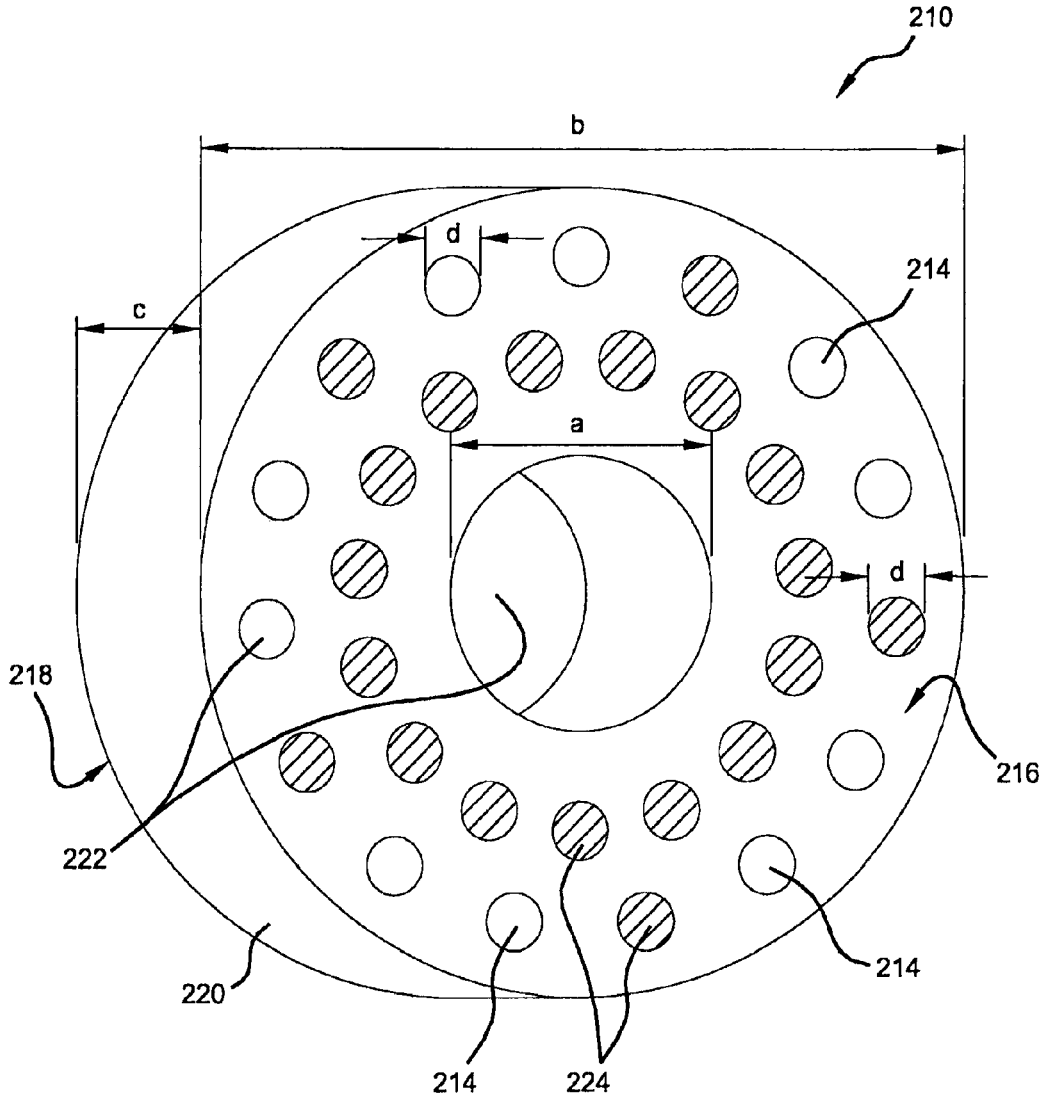
Figure 10:
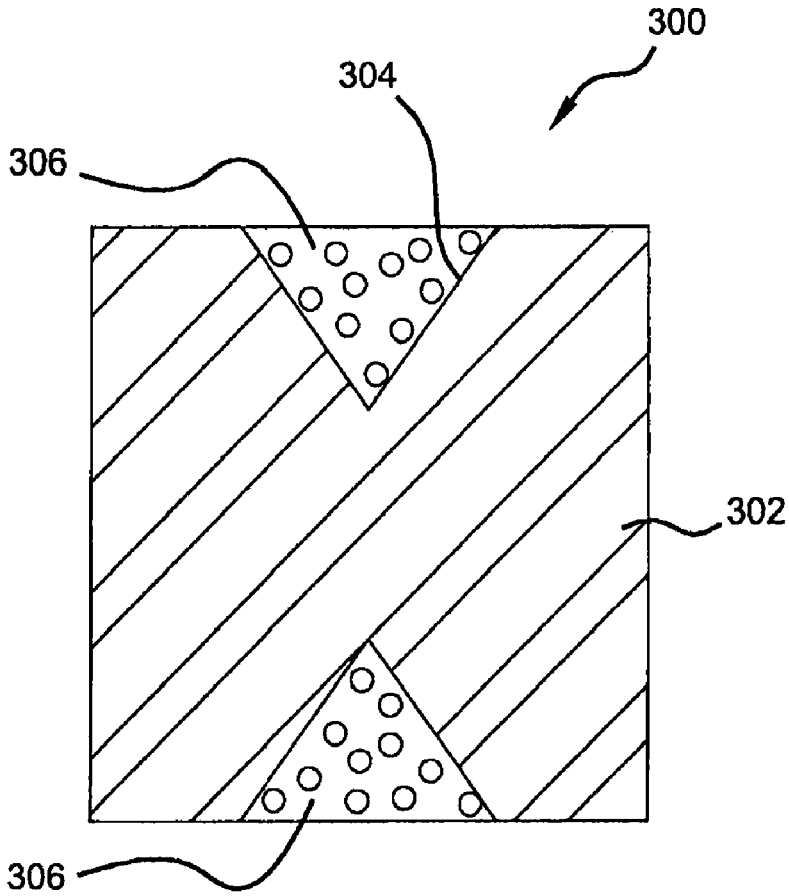

FIG. 9 is an isometric view of a pressed monolith multi-compositional gas generant in accordance with the principles of certain aspects of the present disclosure; and FIG. 10 is an exemplary multi-composition pyrotechnic material where the second region can promote disintegration and accelerated burning of the pyrotechnic material in the primary regions in accordance with some aspects of the disclosure.

DESCRIPTION OF VARIOUS ASPECTS

The following description is merely exemplary in nature and is not intended to limit the present disclosure, application, or uses. It should be understood that throughout the drawings, corresponding reference numerals indicate like or corresponding parts and features. The description and any specific examples, while indicating various aspects of the present disclosure, are intended for purposes of illustration only and are not intended to limit the scope of the present disclosure. Moreover, recitation of multiple embodiments having stated features is not intended to exclude other embodiments having additional features, or other embodiments incorporating different combinations of the stated features.

Inflatable restraint devices preferably generate gas in situ from a reaction of a pyrotechnic gas generant contained therein. In accordance with various aspects of the present disclosure, pyrotechnic materials are provided that comprise multiple compositions in a single grain structure, which enable tailoring of the pyrotechnic material behavior to have superior performance characteristics in an inflatable restraint device.

In various aspects, the disclosure provides a pyrotechnic material for use in a passive restraint system. Examples of such pyrotechnic materials include igniter and/or initiator materials, micro gas generants, and conventional gas generants.

By way of background, inflatable restraint devices have applicability for various types of restraint systems including seatbelt pretensioning systems and airbag module assemblies for automotive vehicles, such as driver side, passenger side, side impact, curtain and carpet airbag assemblies, for example, as well as with other types of vehicles including, for example, boats, airplanes, and trains. While certain exemplary applications for the pyrotechnic materials will be discussed herein, such discussion should not be construed as limiting as to the applicability of the principles of the present disclosure.

Figure 1:
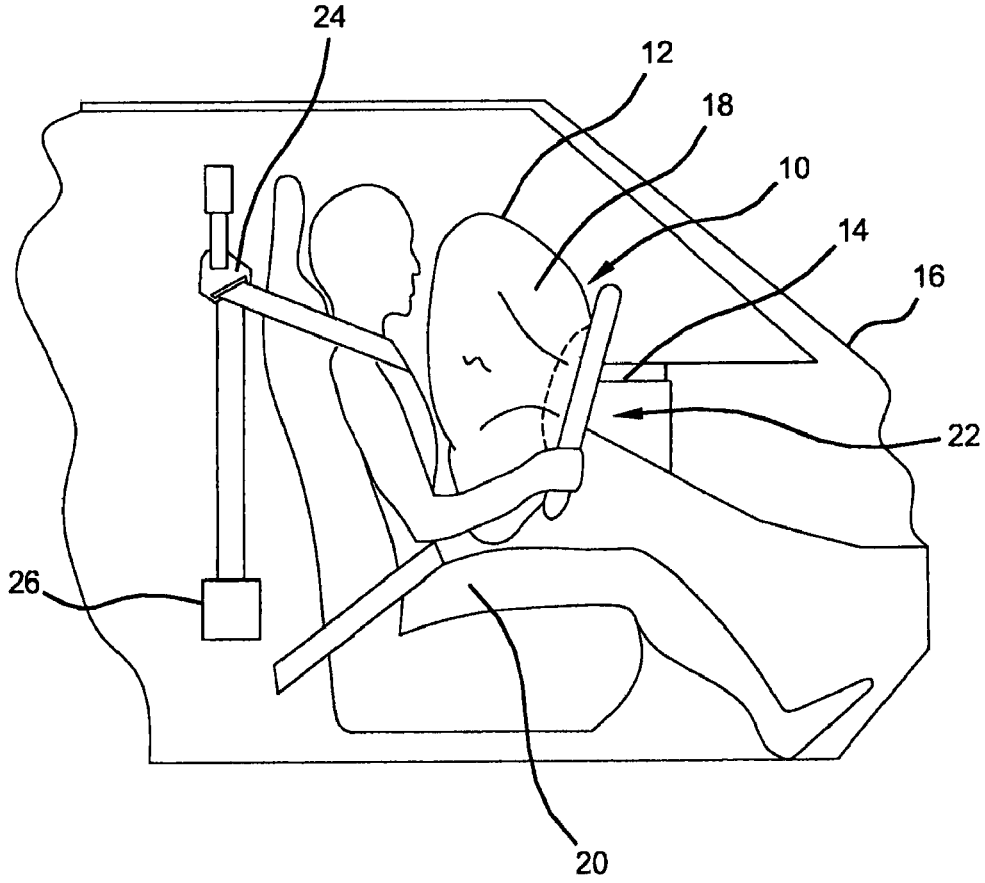
FIG. 1 is a simplified partial side view of an exemplary passive inflatable airbag device system and an exemplary pretensioner system for a seatbelt restraint in a vehicle having an occupant.

FIG. 1 shows an exemplary driver-side front airbag inflatable restraint device 10. Such driver side, inflatable restraint devices typically comprise an airbag cushion or air bag 12 that is stored within a steering column 14 of a vehicle 16. A gas generant contained in an inflator (not shown) in the steering column 14 creates rapidly expanding gas 18 that inflates the airbag 12. The airbag 12 deploys within milliseconds of detection of deceleration of the vehicle 16 and creates a barrier between a vehicle occupant 20 and the vehicle components 22, thus minimizing occupant injuries.

Inflatable restraint devices typically involve a series of reactions, which facilitate production of gas, to deploy the airbag or actuate a piston. For example, for airbag systems, upon actuation of the entire airbag assembly system, the airbag cushion should begin to inflate within a few milliseconds.

Figure 2:
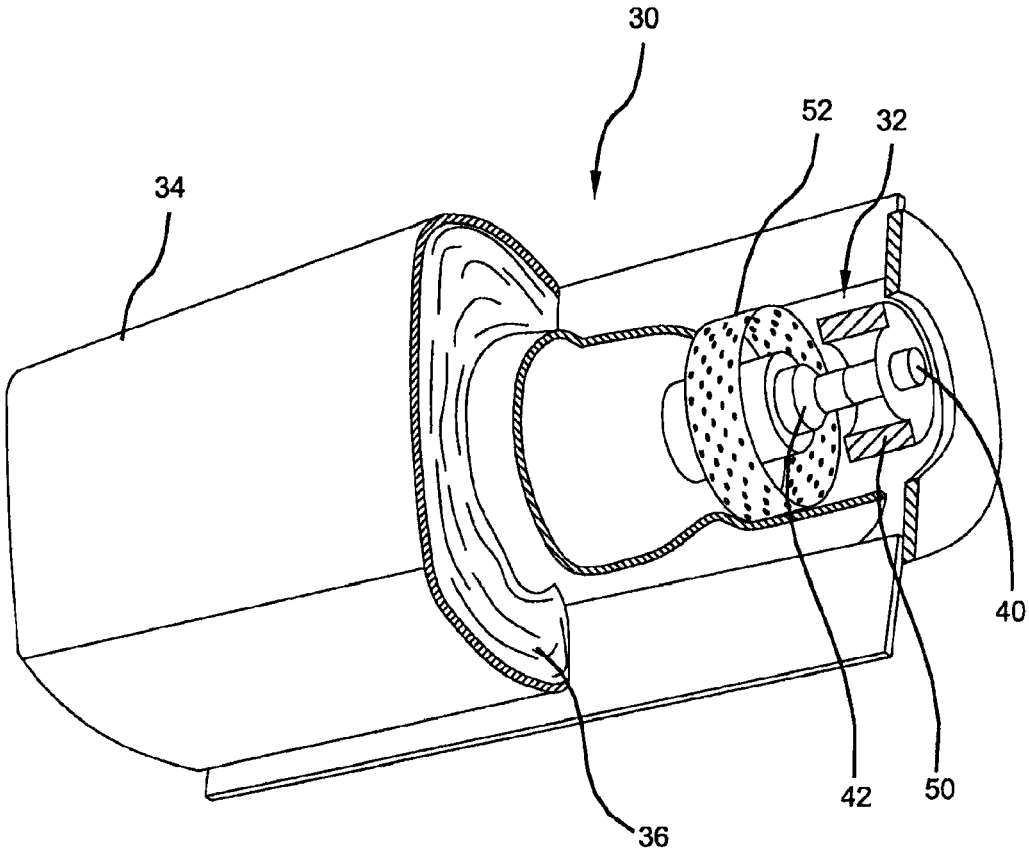
FIG. 2 is an exemplary partial cross-sectional view of a passenger-side airbag module including an inflator for an inflatable airbag restraint device.

FIG. 2 shows a simplified exemplary airbag module 30 comprising a passenger compartment inflator assembly 32 and a covered compartment 34 to store an airbag 36. Such devices often use a squib or initiator 40 which is electrically ignited when rapid deceleration and/or collision is sensed. The discharge from the squib 40 usually ignites an initiator or igniter material 42 that burns rapidly and exothermically, in turn, igniting a gas generant material 50. The gas generant material 50 burns to produce the majority of gas products that are directed to the airbag 36 to provide inflation.

In various aspects, a gas generant 50 comprises pyrotechnic materials and can be in the form of a solid grain, a pellet, a tablet, or the like, which are well known to those of skill in the art. The pyrotechnic material comprises a pyrotechnic fuel, an oxidizer, and other minor ingredients that when ignited combust rapidly to form gaseous reaction products (for example, $CO_2$, $H_2O$, and $N_2$). Gas generants are also known in the art as ignition materials and/or propellants. Thus, a gas generant material comprises one or more compounds that are ignited and undergo rapid combustion reaction(s) forming heat and gaseous products, i.e., the gas generant 50 burns to create heated inflation gas for an inflatable restraint device.

Often, a slag or clinker is formed near the gas generant 50 during burning. The slag/clinker serves to sequester various particulates and other compounds generated by the gas generant 50 during combustion. A filter 52 is optionally provided between the gas generant 50 and airbag 36 to remove particulates entrained in the gas and to reduce gas temperature of the gases prior to entering the airbag 36.

Figure 3:
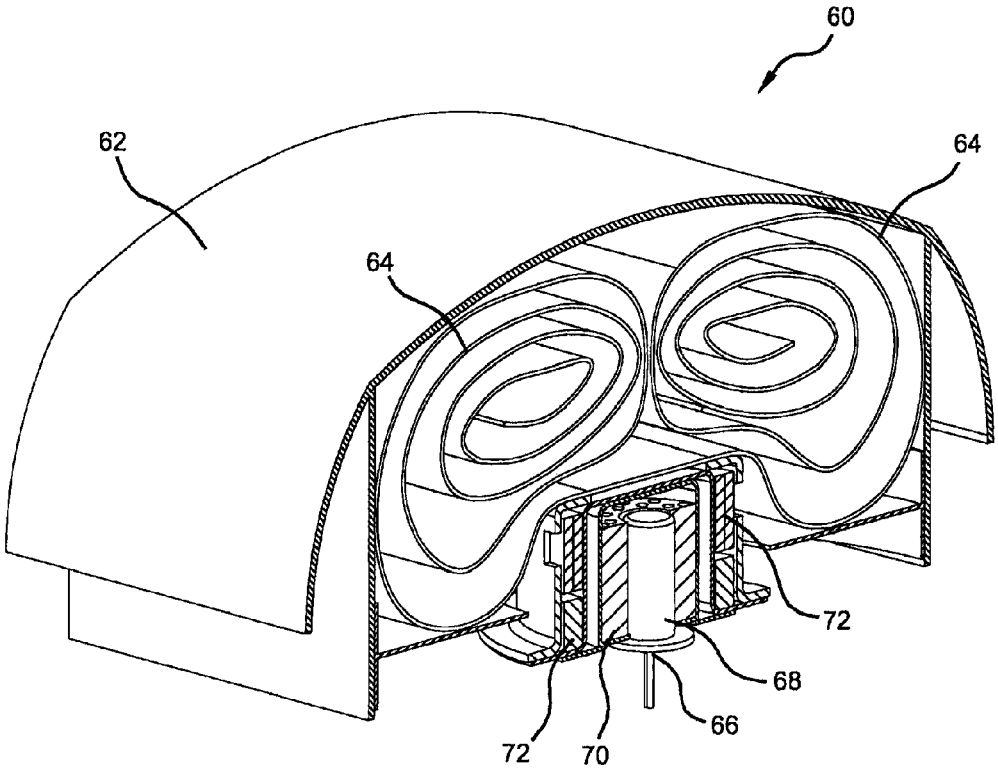
FIG. 3 is an exemplary partial cross-sectional view of a driver-side airbag module including an inflator for an inflatable airbag restraint device.

FIG. 3 shows a simplified exemplary driver side airbag module 60 with a covered compartment 62 to store an airbag 64. A squib 66 is centrally disposed within an igniter material 68 that burns rapidly and exothermically, in turn, igniting a gas generant material 70. Filters 72 are provided to reduce particulate in effluent gases entering the airbag 64 as it inflates. Other pyrotechnic materials can also be employed in safety systems for vehicle passengers.

As shown in FIG. 1, a seatbelt 24 is optionally fitted with a pretensioner system 26, designed to retract and tighten a seatbelt around a passenger in the vehicle. Typically, the seatbelt is tensioned just after a sensor detects the onset of vehicle impact and is known in the art as "pretensioning." The pretensioner 26 frequently uses a pretensioning generator system having a micro gas generator that is fired by a sensor mechanism indicating, for example, rapid deceleration of the automobile. This sensor mechanism is optionally the same sensor used to detect deceleration for deployment of air bags. Micro gas generators are small pyrotechnic materials used to generate gas pressure to produce work, which typically actuate a piston (not shown) within the pretensioner system 26. When the micro gas generator fires, the piston is driven down a cylinder and applies pressure to the seatbelt 24, retracting it and tightening it around the passenger 20.

Figure 4:
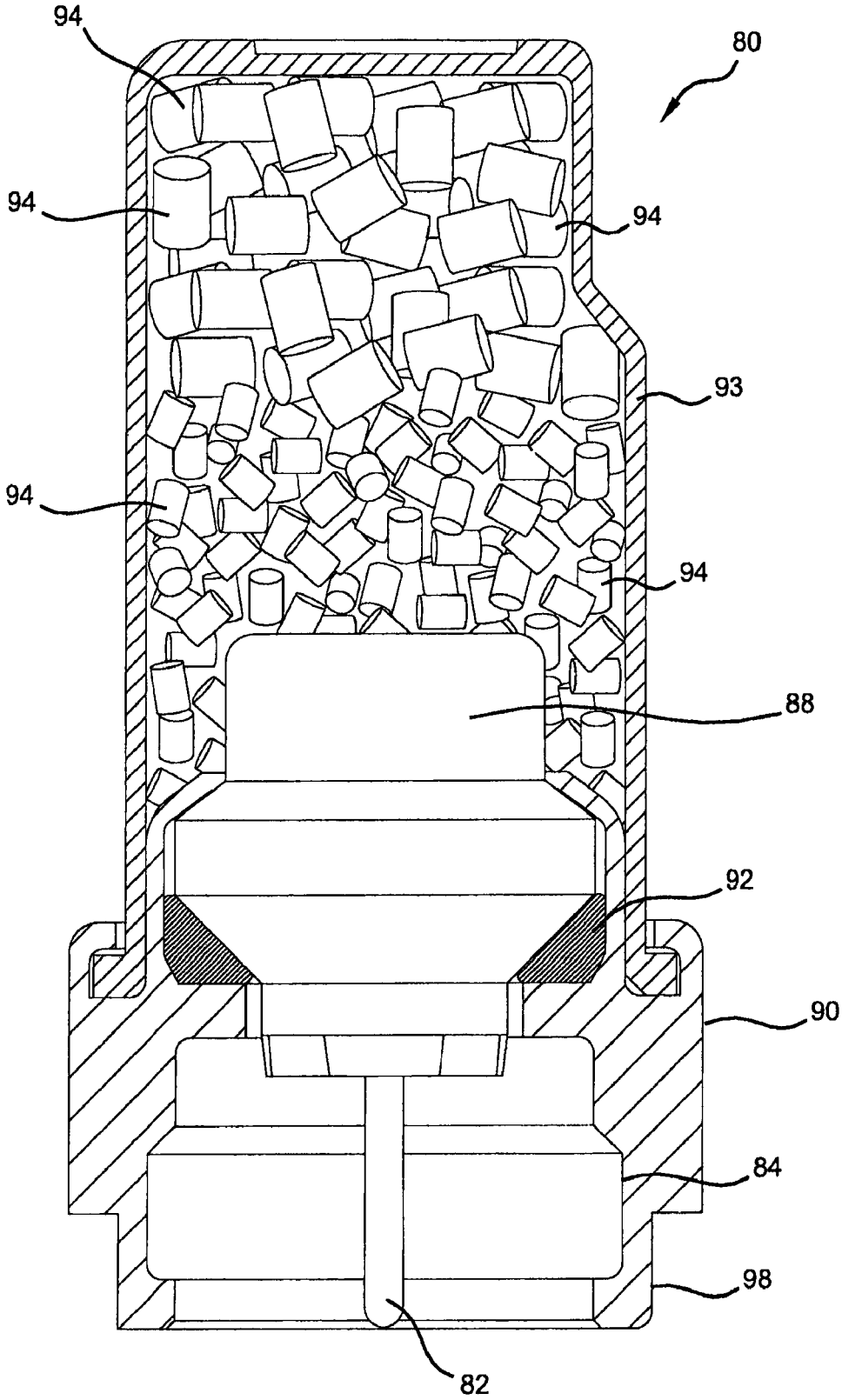
FIG. 4 is a cross-sectional view of an exemplary pretensioning system microgas generator (MGG) for use with a pretensioner for a safety restraint or seatbelt system.

FIG. 4 shows a simplified view of an exemplary seatbelt pretensioning generator system 80. One or more contact pins 82 pass through a header 84. The pin 82, which is sealed through the header 84, carries current produced by an external source (not shown) in response to rapid deceleration of the vehicle, to a metallic bridge wire or similar ignition element, which when electrically energized with an appropriate signal, produces a high temperature arc or spark to initiate the explosion of an initiator material. While not shown here, the initiator material is contained within a cup-shaped holder or inner can 88 that attaches to the top of the header 84.

The holder 88 is fastened into a base 90, and sealed therewithin, typically by an O-ring or other sealing member 92. The assembly of the header 84 and base 90 and associated pin 82 are attached to a metallic output can 93 (sometimes referred to as a director can), which contains a gas generant material 94 to produce the necessary gas pressure output on ignition of the initiator material contained in holder 88.

The lower part of the base 90 typically includes one or more recessed regions 98 to engage a portion of a wiring harness of the automobile, which carries trigger wires from the sensor circuit to pin 82. The pretensioning generator system 80 is placed into a seatbelt pretensioner, such as 26 generally shown in FIG. 1.

As appreciated by those of skill in the art, various pyrotechnic materials, including gas generant materials (50, 70, 94) and initiator materials (42, 68, 88) used for the airbag module assemblies and/or for pretensioning systems are similar, although preferably have respective performance characteristics tailored to their intended use for example, rapid combustion for initiation or sustained combustion to generate gas at a pre-selected pressure for a pre-determined duration. As described above, gas generant and initiator material selection involves various factors, including meeting current industry performance specifications, guidelines and standards, generating safe gases or effluents, handling safety of the gas generant materials, durational stability of the materials, and cost-effectiveness in manufacture, among other considerations. It is preferred that the pyrotechnic compositions are safe during handling, storage, and disposal. Further, it is preferable that the pyrotechnic material compositions are azide-free.

In accordance with various aspects of the disclosure, the pyrotechnic material for use in a passive restraint system comprises a first region having a first pyrotechnic composition and a second region having a second pyrotechnic composition that is distinct from the first pyrotechnic composition. The first region defines one or more void regions. In certain aspects, the first region is a solid body or grain formed of the first pyrotechnic composition. The second pyrotechnic composition is introduced to and disposed within at least one of the one or more void regions, thereby forming the second region of an integrated unitary multi-component pyrotechnic material.

In certain aspects, a solid of the first region has an area of internal bulk and at least one of the void regions extends into and optionally is substantially disposed within the internal bulk of the first region solid. Thus, where the second region is introduced to one or more of such void regions, these second regions are also substantially disposed within the internal bulk of the solid.

In certain aspects, a surface of the first region contacts and preferably is substantially adhered to a surface of the second region. Thus, the surface of the first region is integrated with surface of the second region to provide a physical bond at the interface between the materials which permits storage and use of the pyrotechnic material without separation of the first region from the second region.

As referred to herein, the pyrotechnic material comprises a first and a second region, however, as appreciated by those of skill in the art, a plurality of regions having different compositions are contemplated. Thus, in certain aspects, the first region defines one or more void regions that are capable of being filled with various pyrotechnic material compositions. Hence, as appreciated by those of skill in the art, where the first region defines a plurality of void regions, each of these void regions can be filled with a plurality of distinct compositions (for example, two or more distinct pyrotechnic compositions) that form a multi-composition pyrotechnic material.

In certain aspects, the first region of the multi-composition pyrotechnic ("MCP") material can be formed by pressing or extruding a perforated grain in a conventional manner, forming a concentric or eccentric grain having an adjustable inner core or a primary shape surrounded by an outer shape. Typical pyrotechnic materials are formed into disks, tablets, wafers, grains and the like. The first region can be further processed and oven dried prior to loading with a slurry pyrotechnic composition. In alternate aspects, the first and second regions can be formed concurrently. The first and second regions of the pyrotechnic material can be formed in either a batch or continuous process.

As described above, the first region defines one or more void regions that can be filled with a second pyrotechnic composition that will solidify to form a second region structurally integrated with the first region. Non-limiting examples of void regions include cavities, perforations, apertures, grooves, holes, pockets, channels, and the like, which can be in a variety of shapes within the first region including cylinders, rectangles, cones, pyramids, and the like, as will be described in more detail below. The void regions can also have irregular shapes. In certain aspects, the solid body of the first region can be formed in a variety of shapes including centric or eccentric, round, square, star, cross, or having multiple pockets. Thus, the one or more void regions are defined by the shape of the first region. Hence, the second region of the pyrotechnic material comprising the second pyrotechnic composition thus forms a portion of the body of the pyrotechnic material and is structurally integrated within the pyrotechnic material body, in contrast to a mere coating on the surface of the pyrotechnic material.

It should be noted that the second pyrotechnic composition can be introduced to the first pyrotechnic material to form a void region during processing and concurrent creation of both materials. Thus, the void region(s) are not necessarily preformed prior to introduction of the second composition. For example, the void regions can be defined during co-extrusion of the first and second pyrotechnic compositions together or by introduction of the second composition into the first composition (e.g., by injection) prior to solidification of the first composition. In either case, the second composition in various aspects is integrated with one or more regions of the first region of the pyrotechnic material.

In accordance with the principles of the present disclosure, a unique multi-composition or multi-density or extruded perforated pyrotechnic solid grain is created when the void region(s) are filled with additional pyrotechnic materials, as will be described in more detail below. In certain aspects, the pyrotechnic material is self-adhering and creates a unitary, multi-composition pyrotechnic grain that achieves desirable performance characteristics, such as progressive surface area exposure, burn profile, burn time, combustion pressure, and the like, and further leads to easier tuning of difficult PTC curve (pressure vs. time curve) requirements. In certain aspects, a center perforation (CP) of any number of suitable shapes may be created for the desired PTC. Thus, the incorporation of several distinct pyrotechnic compositions into a single multi-composition grain permits freedom to tailor or tune the pyrotechnic behavior without the need for various separate materials. In this regard, the multi-component pyrotechnic material eliminates the need for dry mixing of two or three loose pyrotechnic materials or different shapes of pyrotechnic materials (e.g., discs or multiple-perforation grains) to achieve unique output characteristics (tailored or tunable rates) for state of the art automotive initiators and micro gas generators.

The principles of the present disclosure permit a design for a pyrotechnic material (e.g., an initiator, a gas generant, or micro gas generator) that has a controlled onset or fast burn time based on inclusion of the second pyrotechnic composition. The first pyrotechnic composition has a different composition from the second pyrotechnic composition and permits an advantage of both designing the burning characteristics of a single pyrotechnic material, as well as further enabling the integration of distinct materials into a single pyrotechnic material structure. In this manner, any number of different pyrotechnic compositions can be selected for the first and second compositions, as recognized by the skilled artisan. The examples provided in the present disclosure are merely exemplary and are not intended to be limiting. In certain aspects, for example, the first pyrotechnic composition has a slower burn rate than the second pyrotechnic composition. In other aspects, the second pyrotechnic composition has a lower auto-ignition temperature than the first pyrotechnic composition.

Methods of forming such multi-composition pyrotechnic materials provide a substantially homogenous and uniform mixture of the materials. Sometimes variability occurs when loose granular shapes are mixed or various material combinations are provided. As described previously, loose materials may classify or separate potentially leading to variable burn characteristics. The methods of disclosure reduce such variability and provide the benefits of certain types of grains, for example, extruded or pressed grains, which enable a sustained output with a slower or more progressive burn rate. This design also allows for cost reductions by process simplification, due to the loading of a single multi-composition grain versus various combinations of loose pyrotechnic materials thereby reducing labor and overhead, while further having safety benefits, including reduced storage and handling of loose dry pyrotechnics. This process also reduces inspection requirements, individual weight verification for each combination and ratio integrity, thus leading to improved output/process capability. In various aspects, the multi-composition pyrotechnic grain can be continuously processed, eliminating complicated drying and slower line speed of current redundant steps of manufacturing processes.

Broadly, in various aspects, a method is provided for making a multi-composition pyrotechnic material. The multi-component pyrotechnic material is formed by making the first region of the pyrotechnic material with a first pyrotechnic composition and making the second region of the pyrotechnic material with a second pyrotechnic composition. The first pyrotechnic composition is distinct from the second pyrotechnic composition, and the second region occupies one or more void regions defined by the first region.

In certain aspects, the making of the first region and the making of the second region can occur concurrently, for example, where the first region and the second region are co-extruded with one another and then subsequently dried. In other aspects, methods of making the first region and second regions are sequential, where the first region is formed first, for example, into a solid form, which occurs prior to making the second region. Then, a second region can be made by introducing the second pyrotechnic composition to void regions defined by the first region.

Accordingly, in certain aspects, a method of forming a multi-component pyrotechnic material includes filling one or more void regions defined by a first solid region with a slurry. The first solid region comprises a first pyrotechnic composition and the slurry comprises a second pyrotechnic composition that is distinct from the first pyrotechnic composition. The slurry disposed within one or more void regions is dried to form a second solid region, thereby forming the multi-composition pyrotechnic material.

"Slurry" refers to a flowable or pumpable mixture of fine (relatively small particle size) substantially insoluble particle solids suspended in a vehicle or carrier. Mixtures of solid materials suspended in a carrier are also contemplated. In certain aspects, the slurry comprises particles having an average maximum particle size of less than about 500 μm, optionally less than or equal to about 200 μm, and in some aspects, less than or equal to about 100 μm.

Thus, the slurry preferably contains flowable and/or pumpable suspended pyrotechnic solids and other materials in a carrier. Suitable carriers include conventional organic solvents as well as aqueous solvents. In certain aspects, the carrier may include an azeotrope which refers to a mixture of two or more liquids, such as water and certain alcohols that desirably evaporate in constant stoichiometric proportion at specific temperatures and pressures. The carrier should be selected for compatibility with the components selected for inclusion in the second pyrotechnic composition to avoid adverse reactions and further to maximize solubility of the several pyrotechnic components of the second composition forming the slurry. Non-limiting examples of suitable carriers include water, isopropyl alcohol, n-propyl alcohol, or combinations thereof.

As appreciated by those of skill in the art, it is preferred that the viscosity of the slurry of the second pyrotechnic composition is such that it can be injected, pumped, extruded, doctor bladed, or smoothed when introduced into the void regions defined by the first region. In certain aspects, the viscosity will be relatively high, having a thick or paste-like consistency to retain the slurry in the void regions. However, the viscosity is not required to be high, for instance, the void regions may optionally be filled with a thinner more liquid-like slurry and then dried within the void regions, in circumstances where the void regions can retain the slurry without undesired leaking or drainage, either by intentional blockage or sealing of the void regions or by the nature or shape of the void regions within the first region (for example, where the void regions do not extend entirely through the bulk of the solid first region). Examples of introducing the slurry to void regions include pumping the slurry, injecting the slurry by application of pressure, extruding the slurry into the desired void regions, filling the void regions with slurry via doctor blade and the like.

In various aspects, the slurry typically has a water content of greater than or equal to about 15% by weight; preferably greater than or equal to about 20% by weight; in certain aspects greater than or equal to about 30% by weight; and in some aspects greater than or equal to about 40% by weight. In certain aspects, the water content of the slurry is about 15% to about 85% by weight. As the water content increases, the viscosity of the slurry decreases, thus pumping and handling become easier, while the retention of the slurry in the void spaces potentially becomes more difficult.

While not limiting, in some aspects, a slurry introduced to the void regions has a suitable viscosity ranging from about 50,000 to about 250,000 centipoise. Such viscosities are believed to be desirable to provide suitable rheological properties that allow the slurry to flow under applied pressure, but also permit the slurry to remain stable and in position once applied to the one or more void regions prior to drying.

The slurry (second composition) occupying the one or more void regions is then dried, where the slurry forms a second region within the first region, as described above. Drying of the first and/or second regions is usually conducted at temperatures ranging from 75° C. to greater than 150° C. for times ranging from 10 minutes to several hours, depending on the desired final moisture content of the solid pyrotechnic material. In alternate aspects, the first and second regions can be concurrently formed by co-extrusion of the first pyrotechnic composition with the second-composition to form the first and second regions concurrently.

In certain aspects, the first region (solid body) having the first pyrotechnic composition has a preliminary loading density of less than about 70% prior to introduction of the second pyrotechnic composition into the one or more void regions. A loading density is an actual volume of pyrotechnic material (here the first pyrotechnic composition forming the first region) divided by the total volume available for the shape. Stated in another way, there should be substantial void region(s) defined within the shape of the pyrotechnic material where the second regions can be formed. In this regard, a preliminary loading density should less than 100%, preferably significantly less than 100%, indicating that there are sufficient void regions within the body shape for the second regions to be formed therein. In certain aspects, the preliminary loading density of the first region of the pyrotechnic material is less than or equal to about 65%, optionally less than or equal to about 50%, and optionally less than or equal to about 40%.

A final loading density for the multi-composition pyrotechnic material is the volume of pyrotechnic material actually occupied (including a volume of both the first and second regions) divided by the total volume available for the shape, after the second regions have been added to the first regions and the final pyrotechnic material is formed. The final loading density is preferably relatively high, in that the void regions defined by the first pyrotechnic composition are filled by the second pyrotechnic composition forming the second region(s). In accordance with various aspects of the present disclosure, it is preferred that a loading density for the pyrotechnic material is greater than or equal to about 60%, even more preferably greater than or equal to about 70%. In certain aspects, a multi-composition pyrotechnic material has loading density of greater than or equal to about 75%, optionally greater than about 80%.

Thus, in certain aspects, while not every void region is necessarily filled by a second composition, the second region of the pyrotechnic material optionally occupies greater than or equal to about 5% of a total volume of the pyrotechnic material shape, preferably greater than about 10%. In some aspects, the second region of the pyrotechnic material occupies greater than or equal to about 15% of a total volume, optionally greater than about 25% of the total volume of the pyrotechnic material.

The ballistic properties of a pyrotechnic material, such as gas generants 50, 70, or 94 shown in FIGS. 2, 3, and 4 are typically controlled by the pyrotechnic material composition, shape and surface area, as well as the burn rate of the material. In certain circumstances, it may be desirable to have void regions that are not filled with second regions to enhance surface area for combustion of the material in the first region. As described above, the pyrotechnic material can take a variety of shapes and configurations, as recognized by those of skill in the art.

Figure 5:
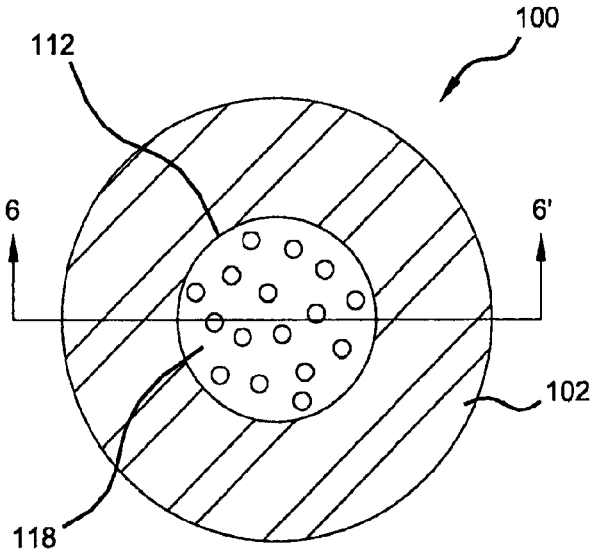
FIG. 5 is a plan view of a multi-composition pyrotechnic material in accordance with the principles of certain aspects of the present disclosure.
Figure 6:
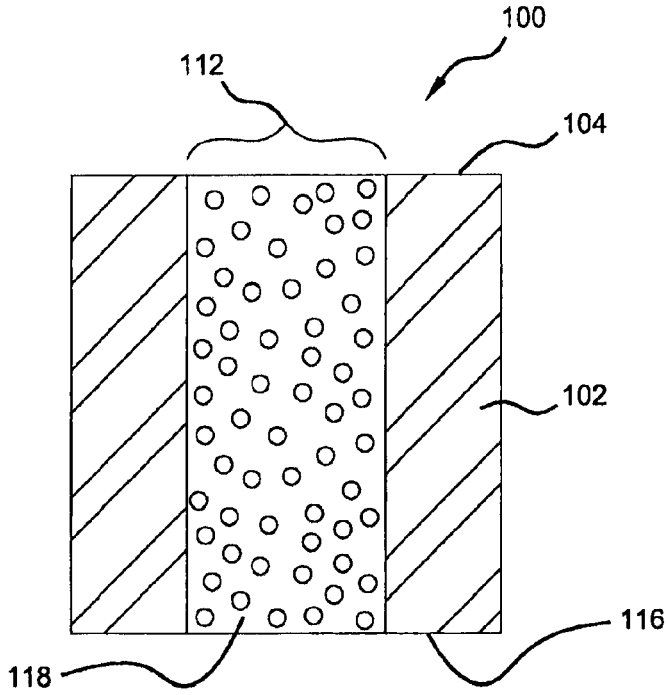
FIG. 6 shows a cross-sectional view along line 6 to 6' of FIG. 5.

For purposes of illustration, FIGS. 5 and 6 show an exemplary multi-composition pyrotechnic material 100. The first region 102 is formed of a first pyrotechnic composition, for example, a gas generant material comprising a pyrotechnic fuel and an oxidizing agent. The first region 102 is formed into an annular shaped disk. The inner diameter forms a central void region 112. This void region 112 extends from a first external side 104 to a second external side 116, opposite to the first side 104. The void region 112 was subsequently filled with a second pyrotechnic composition that formed a second region 118. In this regard, the multi-composition pyrotechnic material has a "bone-and-marrow" or concentric circle configuration that comprises two-distinct pyrotechnic compositions. Alternately, the first and second regions 102, 118 can be concurrently formed in such a configuration by co-extrusion of the first and second compositions together.

Figure 7:
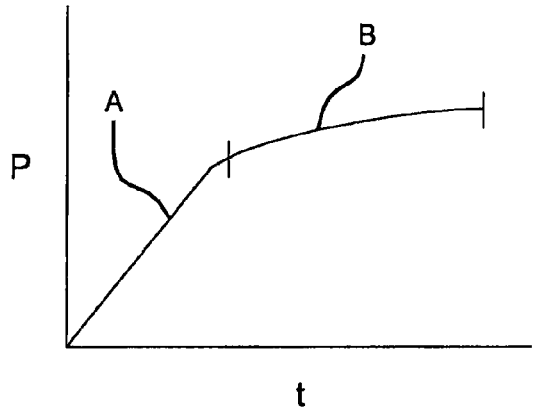
FIG. 7 shows an exemplary pressure versus time curve for combustion of a multi-composition pyrotechnic material.

FIG. 7 shows an exemplary pressure versus time curve (PTC). In micro gas generator applications, a high initial pressure is required. Sometimes, this high initial pressure is difficult to achieve via conventional gas generants alone, particularly because the mass and volume available in such systems is small. As shown in FIG. 7, the desired high initial pressure can be achieved by selecting a second pyrotechnic composition for the second region of the multi-composition pyrotechnic material (for example, having a shape similar to that shown in FIGS. 5 and 6) that has a faster burn rate and high initial pressure than the first composition, for example, booster fuel materials, such as THPP or $BKNO_3$, as will be discussed in more detail below. This region of burning is designated as "A" in FIG. 7. The conventional gas generant material for the micro gas generator is provided in the first region and provides sustained burning and pressure at a relatively slower burn rate, as shown by "B" in FIG. 7.

Figure 8:
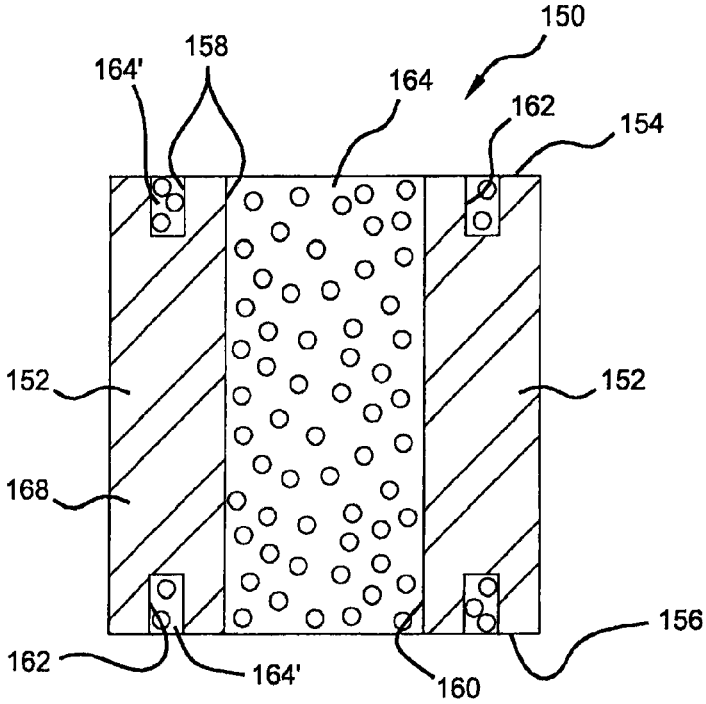
FIG. 8 shows an exemplary alternate multi-composition pyrotechnic material in accordance with certain principles of the present disclosure.

FIG. 8 shows another alternate configuration comprising a pyrotechnic material 150. The first region 152 has a first external surface 154 and a second external surface 156. A plurality of void regions 158 are defined by the first region 152. A primary void region 160 creates a central aperture that extends from the first external surface 154 to the second external surface 156. A second pyrotechnic composition is disposed therein and forms a second region 164. The first region 152 further comprises a plurality of secondary void regions 162 that do not extend through an internal bulk area 168 of the first region, but rather originate on either the first surface 154 or second external surface 156 and only partially protrude into the internal bulk area 168. While these secondary void regions 162 can optionally be filled with additional distinct pyrotechnic compositions, they are shown in FIG. 8 to be filled with the second composition, forming additional second regions 164' that are structurally integrated with the first region to form a unitary pyrotechnic material structure 150.

In another aspect, for purposes of illustration, FIG. 9 depicts a single pressed monolithic gas generant grain shape 210 similar to that disclosed in U.S. patent application Ser. No. 11/472,260 entitled "Monolithic Gas Generant Grains" filed on Jun. 21, 2006 to Mendenhall, et al., which is herein incorporated by reference in its entirety.

The combustion pressure resulting from the burning of a monolithic annular disk grain shape 210 such as that shown in FIG. 9 is distinct from that of a conventional pellet (cylindrical shape) or wafer (a toroidal ring shape). FIG. 9 shows a first region 210 forming a monolithic grain shape in the form of annular disk. Exemplary dimensions of the grain shape of the first region 210 are an inner diameter "a" of about 14 mm, an outer diameter "b" of 41 mm, and a height "c" of about 22 mm. A plurality of apertures 214 extend from a first external surface 216 the grain shape of the first region 210 to a second side 218 of the first region grain 210, thus providing open channels through the body 220 of the first region grain 210 that extend therethrough and define a plurality of void regions 222. The inner diameter, defined by "a," also forms a portion of the void regions 222. Optionally some or even all of these void regions 222 are subsequently filled with a second pyrotechnic composition that forms the second regions 224. As shown in FIG. 9, only some of the void regions 222 are filled with the second pyrotechnic composition to form the second regions 224.

As shown, each aperture 214 has a diameter "d" of about 3 mm. The first region grain 210 as shown has 30 apertures 214, although different configurations, dimensions, and quantities of the apertures 214 are contemplated. The number, size, and position of the apertures 214 may be varied, as they relate to the desired initial surface area and specific burn rate of the gas generant material. Similarly, the dimensions (a, b, and c) of the disk can also be varied, as appreciated by skilled artisans. For example, where multiple disks are employed as gas generant, the height "c" can be reduced. Thus, the volume filled with a second region 224 can be selected based on the desired burn time and other performance characteristics where, as shown, only certain void regions 222 are filled by a second region 224.

The gas generant monolithic grain shown in FIG. 9 has a ratio of the length of the each aperture to the diameter (L/D) of preferably from about 3.5 to about 9. In the specific example shown in FIG. 9, the L/D ratio of each aperture is about 7.3. The ratio of L/D of the plurality of apertures relates to the surface area progression and overall burning behavior of the gas generant. The number of apertures and the ratio of L/D of each aperture relate to the shape or profile of the combustion pressure curve of the gas generant material.

A monolithic shape of the first region gas generant grain 210, similar to that shown in FIG. 9, provides a controlled combustion pressure that provides longer, controlled, and sustained combustion pressure at desired levels which is important for improving inflator effluent properties and for occupant safety during deployment of the airbag cushion.

In some aspects, the shape of the void regions that are filled with the second pyrotechnic composition (i.e., the second regions) can promote progressive burn profiles by creating first regions that disintegrate during burning to expose additional surface area. This is conceptually demonstrated in FIG. 10 having a pyrotechnic material 300 comprising a first region 302 formed of a first composition and defining a plurality of conical and/or pyramidal shaped void regions 304. These void regions 304 are filled with the second composition and form second regions 306. The shape of the grain formed by the first region 302 can be designed to force structural break-up of the first region 302, enabling increased exposure of surface area during the burning process, which enables modification of the burning profile.

The first region has a first pyrotechnic composition that comprises a pyrotechnic component selected from the group consisting of: fuel, oxidizing agents, auto-ignition materials, binders, slag forming agents, coolants, flow aids, viscosity modifiers, dispersing aids, phlegmatizing agents, excipients, burning rate modifying agents, and mixtures and combinations thereof. It is understood that while general attributes of each of the categories of pyrotechnic components described herein may differ, there may be some common attributes and any given material may serve multiple purposes within two or more of such categories of pyrotechnic active components. Thus, classification or discussion of a material within this disclosure as having a particular utility is made for convenience, and no inference should be drawn that the material must necessarily or solely function in accordance with its classification herein when it is used in any given composition. Such pyrotechnic components typically function to improve the functionality and/or stability of the pyrotechnic material during storage; modify the burn rate or burning profile of the gas generant composition; improve the handling or other material characteristics of the slag which remains after combustion of the gas generant material; and improve ability to handle or process pyrotechnic raw materials.

As described above, it is preferred that the second pyrotechnic composition that forms the second region has a distinct composition from the first pyrotechnic composition, to provide desirably distinct performance characteristics. By "distinct" it is meant that the first composition differs from the second composition by at least one component and preferably exhibits a material difference in pyrotechnic characteristics. While the overall compositions are different from one another due to such distinct materials, the first pyrotechnic composition and second pyrotechnic composition are individually and respectively selected from conventional pyrotechnic materials known to those of skill in the art, as will be described herein. Thus, the second pyrotechnic composition forming the second region also comprises a pyrotechnic component selected from the group consisting of: fuel, oxidizing agents, auto-ignition materials, binders, slag forming agents, coolants, flow aids, viscosity modifiers, dispersing aids, phlegmatizing agents, excipients, burning rate modifying agents, and mixtures and combinations thereof. It should be noted that the disclosure contemplates any variety of pyrotechnic compositions known or to be developed in the art and is not limited to any particular examples set forth below.

Conventional gas generant materials comprise at least one fuel. Depending on whether the fuel is fully/self-oxidized or under-oxidized, the generant may further require an oxidizing agent. Many different pyrotechnic materials can be used in the practice of the disclosure. A non-limiting list of typical pyrotechnic fuels suitable for use in either the first or second pyrotechnic compositions, include tetrazoles and salts thereof (e.g., aminotetrazole, mineral salts of tetrazole), bitetrazoles, 1,2,4-triazole-5-one, guanidine nitrate, nitro guanidine, amino guanidine nitrate, metal nitrates and the like. Such fuels are generally categorized as gas generant fuels due to their relatively low burn rates. Such fuels typically require inclusion of oxidizers as well.

In certain aspects, gas generant compositions having suitable burn rates, density, and gas yield for inclusion in the pyrotechnic materials of the present disclosure include those described in U.S. Pat. No. 6,958,101 to Mendenhall et al., the disclosure of which is herein incorporated by reference in its entirety. U.S. Pat. No. 6,958,101 discloses suitable fuels for the pyrotechnic materials of the present disclosure, which comprise non-azide compounds having a substituted basic metal nitrate.

The substituted basic metal nitrate can include a reaction product formed by reacting an acidic organic compound with a basic metal nitrate. The reaction is believed to occur between acidic hydrogen and a basic metal nitrate, such that the hydroxyl groups of the nitrate compound are partially replaced, however, the structural integrity of the basic metal nitrate is not compromised by the substitution reaction. This gas generant optionally comprises a material including a substituted basic metal nitrate that is a reaction product of a nitrogen-containing heterocyclic acidic organic compound and a basic metal nitrate.

Examples of suitable acidic organic compounds include, but are not limited to, tetrazoles, imidazoles, imidazolidinone, triazoles, urazole, uracil, barbituric acid, orotic acid, creatinine, uric acid, hydantoin, pyrazoles, derivatives and mixtures thereof. Particularly suitable acidic organic compounds include tetrazoles, imidazoles, derivatives and mixtures thereof. Examples of such acidic organic compounds include 5-amino tetrazole, bitetrazole dihydrate, and nitroimidazole. According to certain aspects, a preferred acidic organic compound includes 5-amino tetrazole.

Generally, suitable basic metal nitrate compounds include basic metal nitrates, basic transition metal nitrate hydroxy double salts, basic transition metal nitrate layered double hydroxides, and mixtures thereof. Suitable examples of basic metal nitrates include, but are not limited to, basic copper nitrate, basic zinc nitrate, basic cobalt nitrate, basic iron nitrate, basic manganese nitrate and mixtures thereof. In accordance with certain preferred embodiments, the basic metal nitrate of the substituted compound includes basic copper nitrate.

Thus, in certain embodiments, enhanced burn rate gas generant compositions as disclosed in U.S. Pat. No. 6,958,101 include a reaction product of a basic metal nitrate such as basic copper, zinc, cobalt, iron and manganese nitrates, basic transition metal nitrate hydroxy double salts, basic transition metal nitrate layered double hydroxides, and mixtures thereof reacted with an acidic organic compound, such as tetrazoles, tetrazole derivatives, and mixtures thereof.

Substituted basic metal nitrate reaction products formed include 5-amino tetrazole substituted basic copper nitrate, bitetrazole dihydrate substituted basic copper nitrate, nitroimidazole substituted basic copper nitrates, which are all suitable fuels for use in the pyrotechnic materials of the disclosure.

As appreciated by those of skill in the art, such fuel compositions may be combined with additional components in the gas generant, such as co-fuels. For example, in certain embodiments, a gas generant composition comprises a substituted basic metal nitrate fuel, as described above, and a nitrogen-containing co-fuel. A suitable example of a nitrogen-containing co-fuel is guanidine nitrate. The desirability of use of various co-fuels, such as guanidine nitrate, as a portion of the fuel in a pyrotechnic composition is generally based on a combination of factors, such as burn rate, cost, stability (e.g., thermal stability), availability and compatibility (e.g., compatibility with other standard or useful pyrotechnic composition components).

In some aspects, the gas generant compositions include about 5 to about 95 weight % of the substituted basic metal nitrate compound. For example, an enhanced burn rate gas generant composition may include about 5 to about 95 weight % 5-amino tetrazole substituted basic copper nitrate. In certain embodiments, the pyrotechnic gas generant compositions include about 5 to about 60 weight % co-fuel. One specific gas generant composition includes about 5 to about 60 weight % of guanidine nitrate co-fuel and about 5 to about 95 weight % substituted basic metal nitrate.

Generally, various types of pyrotechnic fuels, such as any of those discussed above, can be present in either the first or second pyrotechnic compositions in an amount of greater than about 5% to about 95% by weight of the respective pyrotechnic composition.

Certain pyrotechnic fuels have a more rapid burn time, higher rate of reaction, and/or lower ignition temperature and are regarded as initiator or booster fuels. In certain aspects, such initiator or booster fuels are particularly suitable for inclusion in the second pyrotechnic composition of the multi-composition pyrotechnic material. Such booster materials include ethyl cellulose, nitrocellulose, metal hydride pyrotechnic materials such as zirconium hydride potassium perchlorate (ZHPP) and titanium hydride potassium perchlorate (THPP), zirconium potassium perchlorate (ZPP), boron potassium nitrate ($BKNO_3$), cis-bis-(5-nitrotetrazolato)tetramine cobalt(III)perchlorate (BNCP), and mixtures thereof. Some of these booster fuels, such as ethyl cellulose, may require the inclusion of an oxidizer. Such booster or initiator fuels can be present in an amount of less than or equal to about 50 weight % of either the first or second pyrotechnic compositions.

Oxidizers for pyrotechnic compositions are well known in the art, and include, by non-limiting example, alkali, alkaline earth and ammonium nitrate, nitrites and perchlorates, metal oxides, basic metal nitrates, transition metal complexes of ammonium nitrate, and combinations thereof. Advantageously, the oxidizer is selected to provide or result in a propellant composition that upon combustion achieves an effectively high burn rate and gas yield from the pyrotechnic material. Specific examples of suitable oxidizers include potassium perchlorate, ammonium perchlorate or perchlorate-free oxidizing agents, such as a basic metal nitrate like basic copper nitrate. Basic copper nitrate has a high oxygen to metal ratio and good slag forming capabilities. Such oxidizing agents can be present in an amount of less than or equal to about 50 weight % of the respective first or second pyrotechnic compositions of the pyrotechnic material.

The pyrotechnic compositions optionally comprise an auto-ignition material. An auto-ignition agent is a material that spontaneously combusts at a pre-selected temperature, preferably a temperature lower than that which would lead to catastrophic failure in a gas generant system, such as potential explosion, fragmentation, or rupture of the airbag inflator upon exposure to extreme heat in excess of normal operating condition temperatures. In current systems, these temperatures may range from about 135° C. to greater than about 200° C. The auto-ignition material ignites the booster/initiator composition and/or gas generant resulting in the safe functioning of the gas generant at elevated temperatures. Thus, the gas generant may be ignited by two separate pathways, which include the igniter and the auto-ignition material, enabling safe gas generant deployment during abnormal conditions. Such an auto-ignition material can also be employed to increase the burning of the gas generant during normal operating conditions, in effect, operating as a booster composition. Further, the auto-ignition material may improve coupling of certain pyrotechnic materials to one another.

An auto-ignition material may comprise a single auto-ignition agent or a mixture of agents formulated to auto-ignite at a desired pre-selected temperature. Some examples of suitable auto-ignition materials known in the art include silver nitrate and smokeless powders, such as those sold by E.I. DuPont De Nemours under the trade name IMR 4895. Other examples of suitable auto-ignition materials include those disclosed in U.S. Patent Publication No. 2006/0102259 to Mendenhall et al., which is herein incorporated by reference in its entirety and describes an auto-ignition material comprising a mixture of azodicarbonamide (ADCA) fuel and basic copper nitrate (BCN) oxidizer.

Binders are commonly used in pyrotechnic compositions to retain the shape of the gas generant solids, particularly when they are formed via extrusion and/or molding, and to prevent fracture during storage and use. Further, in the present application, binders may serve to adhere the second composition to the first composition, thereby forming a structural bond between the first region and the second region. For example, a dry blended mixture of various pyrotechnic components can be mixed with a liquid binder resin, extruded, and then cured. Alternatively, solid polymeric binder particles can be dissolved in a solvent or heated to the melting point, then mixed with other pyrotechnic components and extruded or molded. As described above, in certain aspects, the first pyrotechnic composition may optionally be free of binder, however, in some aspects, it may be desirable to provide a binder in both the first and second pyrotechnic compositions to increase adhesion and bonding therebetween. In various aspects, a binder in the second pyrotechnic composition is desirable.

Suitable binders, such as polymeric binders, include organic film formers, inorganic polymers, thermoplastic and/or thermoset polymers. Examples of common polymeric binders include, but are not limited to: natural gums, cellulosic esters, polyacrylates, polystyrenes, silicones, polyesters, polyethers, polybutadiene, and mixtures and combinations thereof.

Other suitable pyrotechnic additives include slag forming agents, flow aids, viscosity modifiers, pressing aids, dispersing aids, or phlegmatizing agents. Non-limiting examples of slag forming agents, such as refractory compounds, are aluminum oxide and/or silicon dioxide. Generally, such slag forming agents may be included in the respective pyrotechnic composition in an amount of 0 to about 10 weight %.

Coolants for lowering gas temperature, such as basic copper carbonate or other suitable carbonates, may be added to the pyrotechnic composition at 0 to about 20% by weight. Similarly, press aids for use during compression processing include lubricants and/or release agents, such as graphite, magnesium stearate, calcium stearate, and can be present in the pyrotechnic composition at 0 to about 2%. In certain aspects, the pyrotechnic materials optionally comprise low levels of certain binders or excipients to improve crush strength, while not significantly harming effluent and burning characteristics. Such excipients include microcrystalline cellulose, starch, carboxyalkyl cellulose, e.g., carboxymethyl cellulose (CMC), by way of example. When present, such excipients can be included in respective pyrotechnic composition at less than 10% by weight, preferably less than about 5% by weight, and more preferably less than about 3%.

Additionally, certain ingredients can be added to modify the burn profile of the pyrotechnic fuel material by modifying pressure sensitivity of the burning rate slope. One such example is copper bis-4-nitroimidazole. Agents having such an affect are referred to herein as pressure sensitivity modifying agents and they can be present in either the pyrotechnic compositions at 0 to about 10% by weight. Such additives are described in more detail in U.S. patent application Ser. No. 11/385,376, entitled "Gas Generation with Copper Complexed Imidazole and Derivatives" to Mendenhall et al., the disclosure of which is herein incorporated by reference in its entirety. Other additives known or to be developed in the art for pyrotechnic materials are likewise contemplated for use in various embodiments of the present disclosure, so long as they do not unduly detract from the desirable burn profile characteristics of the pyrotechnic materials.

Other benefits of the present disclosure include simplification of hardware in the assembly of an airbag module or pretensioner. As can be appreciated, the combination of several different types of materials into a single pyrotechnic composition potentially eliminates the need for separate initiators and/or for multiple (i.e., two-stage) driver inflators. Two drive inflators have two distinct gas generants that are staged in an inflator device to achieve the desired combustion and burn profiles. In a two-stage inflator, the first gas generant has a burn rate and gas yield that provide sufficient gas product to inflate the airbag cushion for a first burning period, but are insufficient to sustain the cushion pressure for the required time through the entire impact/crash period. As such, a second gas generant (sometimes having a different composition) is ignited in a second stage, where it provides pressurized gas product to the bag for a second period during the impact. Such staging can also be used to proportionally respond to impact forces during collision, depending on the severity of the crash. However, two-stage drivers have complex mechanical hardware and control systems and are costly. Further, the dual gas generants can result in uncontrolled sympathetic ignition reactions.

For example, a common configuration for dual stage drivers includes nesting a second igniter system within a first igniter system. The dual igniters create redundancy for various hardware components, including containment equipment, electrical wiring, initiators, shorting clips, staging cups, lids, more complicated bases, and the like. Further, another gas generant loading station is required for the additional stage of generant. During operation, the control of combustion pressure during the second stage of firing is difficult because the first stage may still be firing and/or has already heated the surrounding area with pressurized gas. The flow area between the lid and cup can be inconsistent and combustion pressure can be difficult to control from the second stage. Further, complications can potentially occur by leakage of combustion gas from the first stage into the nestled second stage, where unintentional burning of the second stage generant can occur. Thus, by providing dual gas generant compositions in a single gas generant grain, the need for such complex hardware is potentially eliminated.

Similarly, the inclusion of booster materials in a gas generant can reduce or eliminate the need for an extensive igniter system. Along the same lines, the inclusion of auto-ignition materials in a single pyrotechnic material grain can streamline the architecture of the systems equipment by eliminating the need for separate containment of auto-ignition materials. Thus, the flexibility provided by the principles of the present disclosure provide the potential to reduce and/or eliminate complex hardware and staging systems, while further potentially avoiding safety and performance complications via the use of the improved pyrotechnic materials in a single unitary structure according to various embodiments of the present disclosure. Further, such materials enable the favorable design, including improved burn rate, burn timing, combustion profile, and effluent quality for tuning the performance of various pyrotechnic materials.

The embodiments of the present disclosure can be further understood by the specific examples contained herein. Specific examples are provided for illustrative purposes of how to make and use the compositions and methods of the present disclosure and, unless explicitly stated otherwise, are not intended to be a representation that given embodiments of this present disclosure have, or have not, been made or tested.

EXAMPLE 1

In one example, a 5-amino tetrazole substituted basic copper nitrate fuel for the gas generant is formed by representative substitution reaction (1) set forth above. 72.7 lb of 5-amino tetrazole is charged to 42 gallons of hot water to form a 5-amino tetrazole solution. 272.9 lb of basic copper nitrate is slowly added to the 5-amino tetrazole solution. 5-aminotetrazole and basic copper nitrate are allowed to react at 90° C. until the reaction is substantially complete. To the reaction mixture are added 139.95 lb of guanidine nitrate and 14.45 lb of silicon dioxide. The slurried mixture is then spray dried.

A release agent (inert carbon, i.e., graphite) and 20.83 lb of basic copper carbonate (a coolant) are dry blended with the spray dried composition. The blended powder is placed in a pre-formed die having the desired shape, such as the annular disk shape with a plurality of apertures or void regions, as shown in FIG. 9, for example. The die and powders are placed in a large, high tonnage hydraulic press capable of exerting forces in excess of 50 tons. The raw materials are pressed to form a monolithic gas generant solid.

A slurry is prepared by mixing 2.4.4 g of water, 75 g of $BKNO_3$ and 0.6 g of hydroxypropyl methyl cellulose binder for 8 minutes. The slurry has a viscosity of approximately 25,000 to 35,000 cP. The slurry is applied over the top of the monolithic solid thereby filling the apertures with slurry. A doctor blade compresses the materials removes excess material. The monolithic grain having slurry-filled apertures is dried at 165° C. for 1 hour to form a solid multi-composition pyrotechnic solid grain.

The present disclosure still further provides pyrotechnic compositions that are economical to manufacture. The present disclosure additionally provides a burn rate enhanced pyrotechnic material that overcomes one or more of the limitations of conventional gas generants.

While specific examples have been described in the specification and illustrated in the drawings, it will be understood by those skilled in the art that various changes may be made and equivalence may be substituted for elements thereof without departing from the scope of the present teachings as defined in the claims. Furthermore, the mixing and matching of features, elements and/or functions between various examples may be expressly contemplated herein so that one skilled in the art would appreciate from the present teachings that features, elements and/or functions of one example may be incorporated into another example as appropriate, unless described otherwise above. Moreover, modifications may be made to adapt a particular situation or material to the present teachings without departing from the essential scope thereof. Therefore, it may be intended that the present teachings not be limited to the particular examples illustrated by the drawings and described in the specification as the best mode of presently contemplated for carrying out the present teachings but that the scope of the present disclosure will include any embodiments following within the foregoing description and appended claims.

What is claimed is:

1. A method of forming a multi-composition pyrotechnic material, the method comprising:

filling two or more void regions pre-formed in a first solid region with a slurry, wherein said first solid region comprises a first pyrotechnic composition and the slurry comprises a second pyrotechnic composition that is distinct from the first pyrotechnic composition; and drying the slurry disposed within the two or more void regions to form a second solid region, thereby forming the multi-composition pyrotechnic material having a shape selected from the group consisting of a disk, a wafer, a tablet, a pellet, and a grain.

2. The method according to claim 1, wherein the slurry has a water content of greater than or equal to about 15% by weight.

3. The method according to claim 1, wherein the slurry comprises an aqueous compound.

4. The method according to claim 1, wherein the slurry comprises at least two compounds that form an azeotropic mixture.

5. The method according to claim 1, wherein the slurry comprises particles having an average maximum particle size of less than about 500 μm.

6. The method according to claim 1, wherein the slurry has a viscosity of about 50,000 to about 250,000 centipoise.

7. The method according to claim 1, wherein said first solid region is in contact with and substantially adhered to said second solid region.

8. The method according to claim 1, wherein said first pyrotechnic composition and said second pyrotechnic composition each comprises a component independently selected from the group consisting of: fuel, oxidizing agents, auto-ignition agents, binders, slag forming agents, coolants, flow aids, viscosity modifiers, dispersing aids, phlegmatizing agents, excipients, burning rate modifying agents, and mixtures and combinations thereof.

9. The method according to claim 1, wherein said second pyrotechnic composition comprises a compound selected from the group consisting of: zirconium hydride potassium perchlorate (ZHPP) and titanium hydride potassium perchlorate (THPP), zirconium potassium perchlorate (ZPP), boron potassium nitrate ($BKNO_3$), cis-bis-(5-nitrotetrazolato)tetramine cobalt(III) perchlorate (BNCP), combinations and equivalents thereof.

10. The method according to claim 1, wherein said first pyrotechnic composition has a slower burn rate than the second pyrotechnic composition.

11. The method according to claim 1, wherein said first pyrotechnic composition has a faster burn rate than the second pyrotechnic composition.

12. The method according to claim 1, wherein said second pyrotechnic composition has a lower auto-ignition temperature than the said first pyrotechnic composition.

13. The method according to claim 1, wherein the pyrotechnic material has a final loading density of greater than or equal to about 70%.

14. The method according to claim 1, wherein said solid second region comprises greater than 10% of a volume of a pyrotechnic material body.

15. The method according to claim 1, wherein said one or more void regions defined by said solid first region comprise greater than about 10% of a volume of a shape defined by said first region.

16. A method of forming a multi-composition pyrotechnic material, the method comprising:

creating a solid body comprising a first pyrotechnic composition, wherein the solid body defines two or more void regions; and introducing a second pyrotechnic composition into at least two of said two or more void regions, wherein the first pyrotechnic composition is distinct from the second composition, and thereby forming the multi-composition pyrotechnic material, wherein the first and second compositions each comprise a component selected from the group consisting of: fuel, oxidizing agents, auto-ignition agents, binders, slag forming agents, coolants, flow aids, viscosity modifiers, dispersing aids, phlegmatizing agents, excipients, burning rate modifying agents, and mixtures and combinations thereof, wherein the solid multi-composition pyrotechnic material has a shape selected from the group consisting of a disk, a wafer, a tablet, a pellet, and a grain.

17. A method of forming a multi-composition pyrotechnic material having a first region and a distinct second region, the method comprising:

making the first region of the pyrotechnic material with a first pyrotechnic composition; and making the second region of the pyrotechnic material with a second pyrotechnic composition; wherein said making the first region and making the second region occur concurrently and the first pyrotechnic composition is distinct from the second pyrotechnic composition, and wherein the second region occupies one or more void regions defined by the first region, wherein the first region and the second region are co-extruded with one another and subsequently dried.

18. The method according to claim 16, wherein said introducing the second pyrotechnic composition into at least two of said two or more void regions comprises introducing a slurry to said void regions of said solid body and subsequently drying said slurry.

19. A method of forming a multi-composition pyrotechnic material, the method comprising:

filling one or more void regions pre-formed in a first solid region with a slurry comprising particles having an average maximum particle size of less than about 500 μm, wherein said first solid region comprises a first pyrotechnic composition and the slurry comprises a second pyrotechnic composition that is distinct from the first pyrotechnic composition; and drying the slurry disposed within one or more void regions to form a second solid region, thereby forming the multi-composition pyrotechnic material having a shape selected from the group consisting of a disk, a wafer, a tablet, a pellet, and a grain.

20. The method according to claim 19, wherein said first pyrotechnic composition and said second pyrotechnic composition each comprises a component independently selected from the group consisting of: fuel, oxidizing agents, auto-ignition agents, binders, slag forming agents, coolants, flow aids, viscosity modifiers, dispersing aids, phlegmatizing agents, excipients, burning rate modifying agents, and mixtures and combinations thereof.

21. The method according to claim 19, wherein said second pyrotechnic composition comprises a compound selected from the group consisting of: zirconium hydride potassium perchlorate (ZHPP) and titanium hydride potassium perchlorate (THPP), zirconium potassium perchlorate (ZPP), boron potassium nitrate ($BKNO_3$), cis-bis-(5-nitrotetrazolato)tetramine cobalt(III) perchlorate (BNCP), combinations and equivalents thereof.

22. The method according to claim 19, wherein said first pyrotechnic composition has a faster burn rate than the second pyrotechnic composition.

23. The method according to claim 19, wherein said second pyrotechnic composition has a lower auto-ignition temperature than the said first pyrotechnic composition.

* * * * *